United States Patent [19]

Guillaume et al.

[11] 4,115,343

[45] Sep. 19, 1978

[54] HOMOGENEOUS DISPERSIONS OF DIORGANOPOLYSILOXANE COMPOSITIONS IN MINERAL OILS

[75] Inventors: Andre Guillaume, Lyon; Ferenc Sagi, Bron, both of France

[73] Assignee: Rhone-Poulenc Industries, Paris, France

[21] Appl. No.: 693,687

[22] Filed: Jun. 7, 1976

[30] Foreign Application Priority Data

Jun. 6, 1975 [FR] France ..... 75 17714

[51] Int. Cl.[2] ..... C08K 5/01

[52] U.S. Cl. ..... 260/33.6 SB; 252/49.6

[58] Field of Search ..... 260/33.6 SB, 827; 252/49.6, 56 R

[56] References Cited

U.S. PATENT DOCUMENTS

| | | | |
|---|---|---|---|
| 2,589,317 | 3/1952 | Young | 252/49.6 |
| 2,790,768 | 4/1957 | McCoy | 252/49.6 |
| 3,235,502 | 2/1966 | Waldmann | 252/56 R |
| 3,250,714 | 5/1966 | Ilnyckyj | 252/56 R |
| 3,324,034 | 6/1967 | Merz | 252/56 R |
| 3,445,385 | 5/1969 | Vartanian | 252/49.6 |
| 3,567,639 | 3/1971 | Aaron | 252/56 R |
| 3,947,368 | 3/1976 | Sweeney | 252/56 R |

*Primary Examiner*—Paul R. Michl

*Attorney, Agent, or Firm*—Bacon & Thomas

[57] ABSTRACT

Homogeneous and stable dispersions of organosiloxane polymers in mineral oils are provided by mixing at a temperature above 80° C. organosiloxane polymer compositions and mineral oil compositions and solid ethylene/vinyl acetate copolymer. Such dispersions are excellent foam inhibitors for lubricating oil compositions.

7 Claims, No Drawings

HOMOGENEOUS DISPERSIONS OF DIORGANOPOLYSILOXANE COMPOSITIONS IN MINERAL OILS

BACKGROUND OF THE INVENTION

1. Field of the Invention

This invention relates to homogeneous and stable dispersions of organosiloxane polymers in mineral oil and the process for the preparation.

2. Description of the Prior Art

The dispersions of polymeric organosiloxanes and mineral oil are employed in a wide variety of uses ranging from anti-static finishes on natural and synthetic fibers to antifoam agents in motor oils hydraulic fluids lubricants and greases. For many of these uses the mineral oil would be the major component. One vexing problem associated with dispersions is due to the inherent relative immiscibility of the organosiloxane polymers and mineral oils which form separate phases after a short period of time. To overcome this problem of phase separation various additives generally in the nature of emulsifiers have been employed, which are effective for the intended purposes but, characteristically increase the foaming tendencies of the mineral oil component. Another approach is described in U.S. Pat. No. 3,445,385 which discloses the use of organic ammonium complexes of clays of the montmorillonite group as dispersing agents. However, the stability of these "organophilic organo-anmonium bentonite" dispersions still falls short of that desired especially the storage stability required for long periods.

While the foregoing problem of compatibility is related to the dispersion per se, the use of organosiloxanes as anti-foam agents in mineral oil compositions presents another problem. In the preparation of oil compositions for use as motor oils, hydraulic fluids, lubricants, greases and the like, various additives are used to prevent sludging, deposition of gum and resinous materials or similar objectionable results. These additives are generally detergents which increase the foaming tendencies of the oil composition along with conventional antioxidants, pour point depressants, extreme pressure agents and the like. Organosiloxane polymers have been employed to combat such foaming of oil compositions. Unfortunately, however, the polysiloxanes which initially suppress foaming, lose their effectiveness in a relatively short period of time. Many materials have been suggested for prolonging the foam-inhibiting action of the polysiloxanes with generally indifferent success.

Any means for increasing the stability of the dispersion per se and extending the effectiveness of the foam suppressing characteristics of organosiloxane polymers in mineral oils would be advantageous.

SUMMARY OF THE INVENTION

According to this invention homogeneous dispersions of organosiloxane polymers in mineral oil having markedly improved stability per se and which are markedly improved as anti-foaming agents in mineral oils are provided by incorporating ethylene/vinyl acetate copolymers into the dispersions. These homogeneous and stable compositions comprise:

(A) 4 to 40 weight percent of an organosiloxane polymer composition comprising (1) 80 to 100 weight percent of an organosiloxane polymer of the formula:

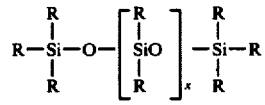

wherein R which may be identical or different is an alkyl group of 1 to 3 carbon atoms $x$ is a number between 30 to 2,000

(2) 0 to 20 weight percent of silicas having a specific surface area greater than 50 $m^2/g$, (B) 55 to 95 weight percent of mineral oils composition, (C) 1 to 12 weight percent of an ethylene/vinyl acetate copolymer having a vinyl acetate content from 15 to 40 weight percent.

It is an object of this invention to provide a homogeneous dispersion of organosiloxane polymers having improved storage stability.

It is yet another object of this invention to provide a method for preparing the above homogeneous and stable dispersions.

Another object achieved by this invention is the provision of new and improved anti-foam agents and compositions capable of suppressing and inhibiting foaming of mineral oils and mineral oil compositions when dispensed therein in minute amounts.

A further object achieved by the present invention is the provision of new and improved oil compositions particularly improved mineral oils, hydraulic fluids, lubricants and greases having marked resistance to foaming and other advantageous properties including resistance to emulsification and containing minute amounts of an oil-insoluble anti-foam agent dispersed therein.

Among the objects achieved by this invention is the provision of an improved method of preventing foaming of mineral oils and mineral oil compositions in which the normal foaming tendency of the oil is effectively suppressed for long periods of use without deleteriously affecting the other properties of the oil.

DESCRIPTION OF THE PREFERRED EMBODIMENTS

Briefly, the dispersion compositions of this invention comprise from 4 to 40 weight percent, preferably 7 to 35 weight percent of the organosiloxane polymer compositions, from 55 to 95 weight percent, preferably from 60 to 90 weight percent of the mineral oils and from 1 to 12, preferably 2 to 10 weight percent of the ethylene/vinyl acetate copolymer.

These dispersions are stable on storage for at least 6 months in closed vessels and in open vessels which afford the protection from impurities and dust.

The homogeneous and stable dispersions of this invention can be prepared by following the methods currently employed for the manufacture of emulsions or microdispersions of solid organic copolymers in organic or aqueous liquid media. The solid ethylene/vinyl acetate copolymer can be combined with the organosiloxane polymer and stirred at a temperature above about 80° C. Generally, the mixing temperatures range from about 80° C. to 200° C. and preferably from about 100° C. to 200° C. to accommodate the relatively high softening points of the ethylene/vinyl acetate which range from 80° C. to 200° C. as determined by ASTM Method E-28. This combination is maintained at this temperature for at least one-half hour to insure that a good mixture is obtained. Then the mineral oil component can be added incremently. After the first addition of mineral oil generally one-third to one-half of the total mineral oil charge, the mixture is heated to about 150° C. and maintained at that temperature for an hour and then converted to a dispersion in a colloid mill. After milling the resultant dispersion is diluted with the remaining fraction of mineral oil with stirring. The resulting composition provides a homogeneous and stable dilute dispersion.

Alternatively, the ethylene/vinyl acetate may be hot mixed with the mineral oil component to which is added the organosiloxane polymer prior to dispersion on the colloid mill.

The liquid organosiloxane polymers or condensation products are sometimes referred to as silicone oils. They are usually produced as condensation products or polymerization products of organosilicols and are of the general formula:

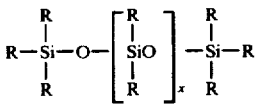

wherein R, which may be identical or different is an alkyl group of 1 to 3 carbon atoms such as methyl, ethyl and propyl with at least 50% of these groups being methyl and $x$ is any number from 30 to 2,000 and preferably from 50 to 1,500. The organosiloxanes useful in this invention are linear polymers consisting essentially of a succession of $R_2SiO$- units as the backbone of the polymer chain. A small amount of other units such as those having the structure $SiO_2$ and R Si $O_{1.5}$ may be present in the polymer backbone if their proportions relative to the number of $R_2SiO$ units does not exceed one percent. These organosiloxane polymers are generally characterized by their viscosities at 25° C. depending on the value of $x$. Generally these viscosities will range from about 50 to about 500,000 centistokes (cs.) and preferably from about 300 to 100,000 cs.

The organosiloxane polymers are compounds well known in the art. See for example French Pat. Nos. 978,058, 1,025,150 and 1,108,764. The dialkylpolysiloxane polymers are commonly employed and vary widely in molecular weight depending on the length of the polymer chain. These organosiloxanes have the general formula:

$$(CH_3)_3\,SiO\text{-}[Si(CH_3)_2O]_{x_1}\,Si(CH_3)_3$$

$x_1$ is a number from 40 to 2,000

$$(CH_3)_3\,SiO\text{-}[Si(CH_3)_2O]_{x_2}\,[Si(C_2H_5)\,(CH_3)O]_{x_3}\,Si(CH_3)_3$$

$x_2$ is a number from 30 to 1500
$x_3$ is a number from 5 to 200

$$(CH_3)_3SiO\text{-}[Si(CH_3)_2O]_{x_4}\,[Si(C_3H_7)\,(CH_3)O]_{x_5}\,Si(CH_3)_3$$

$x_4$ is a number from 25 to 1,100
$x_5$ is a number from 5 to 100

The dimethylpolysiloxanes are most commonly employed.

The organosiloxane polymers may be used alone or with up to 20 weight percent of finely divided silica. Finely divided silicas having a mean particle diameter less than 0.1 micron and a specific surface area exceeding 300 $m^2/g$ and containing from 0.4 to 8 weight percent of absorbed water may be incorporated into the organosiloxane polymer component. Suitable silicas include pyrogenic silicas, silica aerogels, silica xerogels, precipitated silicas and the like. The amount of silicas can vary from 0 to 20 weight percent, preferably from 0 to 15weight percent of the total organosiloxane polymer component of the dispersion. The organosilicone polymer component (A) can range from 4 to 40 weight percent and preferably 7 to 35 weight percent of the total dispersion.

The mineral oil component (B) employed herein can be produced from natural occurring or mineral deposits. These mineral oils are commercially available and can be obtained from petroleum, coal, gas, shale and bituminous schists. The resulting mineral oils are categorized as paraffin oils, naphthene oils and aromatic oils. Most commonly used mineral oils according to this invention are derived from petroleum and are of the lubricating oil viscosity range. For example, a paraffin oil, having low contents of aromatic and olefinic compounds and having a high viscosity index generally greater than 80 (measured in accordance with ASTM METHOD - D - 547-41). The mineral oils can be employed alone or they can contain one or more additives. These additives are well known and improve the physical and rheological properties of the base mineral oil. Thus, for example, one or more of the following types of conventional additives may be employed, such as antioxidants, detergents, anti-rust agents, anti-sludge agents, viscosity improvers, pour point depressants, extreme pressure agents and the like. Such additives are described in particular in U.S. Pat. Nos. 3,554,911 and 3,627,681 and in French Patent Application No. 2,206,376.

The mineral oil component (B) comprises the major portion of the dispersion composition and is used in an amount from 55 to 95 weight percent and preferably from 60 to 90 weight percent of the total dispersion.

The copolymer component (C) is a solid copolymer of ethylene and vinyl acetate containing from 15 to 40 weight percent vinyl acetate, and preferably from about 17 to 26 weight percent vinyl acetate. The ethylene vinyl acetate copolymers which can be employed herein generally exhibit a melt index between about 2 and 600 grams per 10 minutes and good results can be obtained with copolymers having a melt index between about 2 and 470 grams per 10 minutes. Exemplary ethylene vinyl acetate copolymers useful in the practice of this invention are listed in Table I.

TABLE I

| Trademark | Supplier | Melt index, gms./10 min. | Vinyl acetate content, wt. percent |
|---|---|---|---|
| Elvax 210 | E. I. du Pont de Nemours & Co. | 335–465 | 27–29 |
| Elvax 260 | " | 5–7 | 27–29 |
| Elvax 310 | " | 335–465 | 24–26 |
| Elvax 350 | " | 16–22 | 24–26 |
| Elvax 360 | " | 1.6–2.4 | 24–26 |
| Elvax 410 | " | 430–580 | 17–19 |
| Elvax 420 | " | 125–175 | 17–19 |
| Elvax 460 | " | 2.1–2.9 | 17–19 |

A particularly preferred copolymer for use in the compositions of this invention is an ethylene/vinyl acetate copolymer that contains 17 to 19 weight percent/vinyl acetate and exhibits a melt index of about 2 to 3 grams per 10 minutes. A commercial ethylene/vinyl acetate copolymer exemplary of this preferred copolymer is marketed by E. I. du Pont de Nemours & Company under the trademark ELVAX 460.

A particularly preferred copolymer is an ethylene/vinyl acetate copolymer that contains 17 to 19 weight percent vinyl acetate and exhibits a melt index of about 125 to 175 grams per 10 minutes. A commercial ethylene/vinyl acetate copolymer exemplary of this copolymer is marketed under the trademark ELVAX 420.

Another particularly preferred copolymer is an ethylene/vinyl acetate copolymer that contains 17 to 19 weight percent vinyl acetate and exhibits a melt index of about 430–580 exemplary of this copolymer is marketed under the trademark ELVAX 410.

Another preferred copolymer is an ethylene/vinyl acetate copolymer that contains about 24 to 26 weight percent vinyl acetate and exhibits a melt index of about 335 to 465 grams per 10 minutes. A commercial ethylene vinyl acetate copolymer exemplary of this copolymer is marketed under the trademark ELVAX 310.

The term "melt index" as employed herein is the flow rate reported as the rate of extrusion in grams per 10 minutes as determined by ASTM test Method D1238-65T entitled "Measuring Flow Rates of Thermoplastics by Test Condition E, ASTM Standards, American Society Extrusion Plastometer" and performed under Standard for Testing and Materials, Part 27, June 1969, pages 455-466, which procedure is herein incorporated by reference.

The dispersions of this invention provide foam-inhibited mineral oil compositions when mixed with a large volume of mineral oils; thus they can be introduced into these mineral oils in amounts which are sufficient to provide from 5 to 30 parts of organopolysiloxane compositions per million parts of the mixtures of mineral oils and dispersions. The dispersions are homogeneously distributed in these oils by simple stirring. By contrast direct introduction of the organopolysiloxane polymers into the mineral oils, i.e. without first dispensing them, makes it very difficult to achieve homogeneous distribution in mineral oils.

These mineral oils are principally used as motor oils, hydraulic fluids, transmission oils, rear axle lubricants and greases and generally contain additives which serve to improve the properties of mineral lubricating oils. These additives are well known and have been mentioned above.

In another embodiment of this invention, the dispersions according to this invention can be pre-mixed with the above-mentioned additives, and the resulting modified dispersions maintain the improved stability and anti-foam characteristics of the dispersions per se. The advantage of these modified dispersions is that they can be stored and used for subsequent addition to mineral lubricating oils. Another advantage inherent in this embodiment of this invention is that it provides for lubricating oils which in addition to containing conventional additives also contain dispersions having powerful foam suppressing characteristics without the necessity of carrying out two separate mixing operations. These modified dispersion compositions can contain from 0.01 to 0.3 weight percent of the organopolysiloxane polymers.

A full understanding of the invention will be had from the following examples which any of the percentages are given by weight.

EXAMPLE 1

100 grams of an organosiloxane polymer having a viscosity of 300 cs. at 25° C. having the general formula

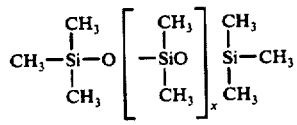

are introduced into a 1 liter vessel equipped with a stirrer. With stirring 40 g of an ethylene/vinyl acetate copolymer, containing 17 to 19 percent by weight of vinyl acetate and having a melt index of 125–175 g/10 minutes according to ASTM Method - D 1238-62 T, condition E, the copolymer being sold under the trademark ELVAX 420 and being in the form of granules of mean particle diameter 2.5 mm, are introduced into the vessel over a period of 3 minutes. The mixture is then heated to 150° C. after which it is maintained at this temperature for 1 hour.

After this period of heating, 360 g of a paraffinic mineral oil, SAE 90, having a viscosity index of 90 as determined by ASTM Method - D - 567-41 are added to the contents of the vessel over the course of 1 minute. The resulting mixture is then heated at 150° C. for 1 hour after which it is introduced into a colloid mill with cones spaced 0.10 mm apart. The mill is started and a dispersion issues therefrom and is collected in a 2 liter vessel.

Finally, 500 g of SAE 90 mineral oil are added to this vessel over a period of 15 minutes, with stirring. The dilute dispersion obtained, which contains 10% by weight of the organosilicone polymer is stable on storage and does not separate into several layers after being left for 6 months at ambient temperature.

EXAMPLE 2

By way of comparison, another dilute dispersion is prepared by repeating the preceding experiment except that the 40 g of the ethylene/vinyl acetate copolymer is replaced by 40 g of (Bentone 38) dimethyldioctodedecylammonium hectorite, and which is described in Example 1 of U.S. Pat. 3,445,385. It is found that this dispersion separates into two distinct layers after standing for 48 hours at ambient temperature.

EXAMPLE 3

This example shows the preparation of a modified dispersion of this invention containing conventional lubricating oil additives.

0.3 g of the dilute dispersion prepared in Example 1 and stored for 3 months, 99.7 g of a mineral oil composition consisting principally of a paraffinic mineral oil of viscosity 21 cs. at 38° C. having a viscosity index of 100, as determined by ASTM Method - D-567-41 and containing, per kilogram, 10 millimols of a zinc bis-(octylphenyl)-dithiophosphate, 60 millimols of a calcium alkylsulphonate containing an excess of alkali and 20 millimols of a zinc dinonylnaphthalenesulphonate, as additives, are introduced into a 250 $cm^3$ glass flask equipped with a stirrer.

This mixture is stirred at 1000 rpm and simultaneously heated to 60° C. and maintained at this temperature for 10 minutes. The composition obtained has the appearance of a homogeneous liquid of deep brown color and contains 0.030% by weight of the organosiloxane polymer component. After standing for 1 hour at ambient temperature, the modified dispersion is poured into a measuring cylinder of 100 $cm^3$ capacity and 25 mm internal diameter, the introduction being stopped when the cylinder is filled substantially to a height of 20 cm.

In order to determine the anti-foam activity of the organosiloxane polymer in a mineral lubricating oil containing conventional additives, as well as the stability of the modified dispersion composition prepared as in Example 3, experiments are carried out following the recommendations of standard specification NF T 60-129-62 which is technically equivalent to ASTM Method - D 892-58T. Each batch of the foam inhibited mineral oil lubricating composition is obtained in accordance with the following working procedure: 6.4 grams of the modified composition prepared as in Example 3 and 193.6 grams of SAE 90 paraffinic mineral oil are charged into a 500 $cm^3$ glass flask equipped with a stirrer. The mixture is stirred at 800 rpm and simultaneously heated to 65° C. and then maintained at this temperature for 10 minutes.

Each batch of the above prepared foam inhibited mineral oil composition thus contains 9.6 parts per million of the organosiloxane polymer having a viscosity 300 cs. at 25° C. The 6.4 g of the foam inhibited mineral oil lubricating composition so prepared are taken from the batch on the 1st day, 15th day and 30th day after the preparation of this composition. The samples taken on the 15th and the 30th day are taken at the top and at the bottom of the column of liquid placed in the measuring cylinder described in Example 3.

The following are determined on the actual day of preparation of the foam inhibited mineral oil composition, with the aid of the above-mentioned standard specification NF T 60-129-62:

(1) The foaming tendency of each batch of the modified mineral oil composition first at 93° C. and then at 24° C. is recorded in $cm^3$, the volume of foam formed by bubbling dry air into each batch of oil for a given time and at a given rate, each batch being placed in a 1,000 $cm^3$ measuring cylinder which is itself placed in a thermostatically controlled bath which provides a constant temperature of 93° C. or 24° C.

(2) The stability of the foam, is recorded in seconds, the time required for disappearance of the foam or, if after 10 minutes the foam has not completely disappeared, the residual volume.

By way of comparison, experiments are carried out with the SAE 90 paraffinic mineral oil containing only the conventional additives described in Example 3 not being modified by the dispersion prepared in Example 3.

The results of these various experiments are shown in Table II below:

TABLE II

| Lubricating Oils | | Test at 93° C. Foaming tendency | Test at 93° C. Stability of the foam | Test at 24° C. after the experiment at 93° C. Foaming tendency | Test at 24° C. after the experiment at 93° C. Stability of the foam |
|---|---|---|---|---|---|
| Mineral Oil With Conventional Additives | | 380 $cm^3$ | 540 secs. | 190 $cm^3$ | 150 $cm^3$ after 10 min. |
| Mineral oil containing the modified dispersion prepared as in Example 3 | | | | | |
| Composition samples on: | | | | | |
| the first day | | 0 | | 0 | |
| the 15th day | top | 0 | | 0 | |
| | bottom | 0 | | 0 | |
| the 30th day | top | 0 | | 0 | |
| | bottom | 0 | | 0 | |
| after preparation | | | | | |

These results highlight the anti-foam effect resulting from the presence of a small amount of organosiloxane polymer in a mineral oil and the stability of this dispersion in a mineral oil composition containing relatively large amounts of conventional additives, for example those contained in transmission gear lubricating oils.

EXAMPLES 4–11

Dispersions of organosiloxane polymers are prepared following the procedure described in Example 1. The organosiloxane polymers are dimethylpolysiloxane polymers blocked by a trimethylsiloxy group at each chain end. However, each dispersion prepared differs from the other by either viscosity of the organosiloxane polymer or the nature of the vinyl acetate copolymer or the respective proportions of the organosiloxane polymer, the copolymer and the mineral oil.

EXAMPLE 12

This example illustrates a dispersion composition containing silica.

95 parts of a dimethylsiloxane polymer blocked at each chain by a trimethylsiloxy group, having a viscosity of 500 cs. at 25° C. are blended with 5 parts of a pyrogenic silica having a specific surface area of 200 $m^2/g$ for 1 hour. The resultant mixture is then passed through a colloid mill with cones spaced 0.25 mm apart. After milling the resultant dispersion is subjected to the procedure as described in Example 1.

The composition of the dispersions prepared in Examples 4–12 are shown in Table III which follows:

TABLE III

| | Organo Siloxane Polymer | | Ethylene/ vinyl acetate copolymers | | SAE 90 mineral oil |
|---|---|---|---|---|---|
| Examples | Viscosity in cs. at 25° C | Amounts | Trademark | Amounts | Amounts |
| 4 | 300 | 100 | Elvax 410 | 40 | 860 |
| 5 | 300 | 100 | Elvax 410 | 60 | 840 |
| 6 | 500 | 100 | Elvax 420 | 60 | 840 |
| 7 | 1,500 | 100 | Elvax 460 | 40 | 860 |
| 8 | 800 | 100 | Elvax 460 | 60 | 840 |
| 9 | 1,000 | 200 | Elvax 420 | 80 | 720 |
| 10 | 2,500 | 300 | Elvax 420 | 60 | 640 |
| 11 | 1,000 | 100 | Elvax 310 | 40 | 860 |
| 12 | 500 | 100 | Elvax 420 | 40 | 860 |

The dispersions mentioned in the above Table III did not change after 6 months storage at ambient temperature.

EXAMPLES 13–21

Preparation of Modified Dispersions

A portion of each dispersion described above after three months storage is mixed with an amount of mineral oil lubricating composition containing conventional additives as described in Example 3 to yield nine different samples of modified dispersions or lubricating oil additive compositions containing 0.03 weight percent of the organosiloxane polymer. For the dispersions prepared from Examples 4–5 and 8–12, the procedure does not differ from that presented in Example 3, i.e., 0.3 grams of dispersion and 99.7 grams of the mineral oil composition containing additives. In preparing the modified additive compositions of Example 15 the formulation was changed to 0.15 grams of the dispersion of Example 6 and 99.85 grams of the mineral oil composition were mixed.

In preparing the modified additive composition of Example 16, 0.1 grams of the dispersion of Example 7 and 99.99 grams were mixed. The dispersions and their corresponding modified dispersions are shown in Table IV below:

TABLE IV

| Dispersion | | | Modified Additive Compositions | |
|---|---|---|---|---|
| Example | 4 | → | Example | 13 |
| " | 5 | → | " | 14 |
| " | 6 | → | " | 15 |
| " | 7 | → | " | 16 |
| " | 8 | → | " | 17 |
| " | 9 | → | " | 18 |
| " | 10 | → | " | 19 |
| " | 11 | → | " | 20 |
| " | 12 | → | " | 21 |

EXAMPLES 22–30

Preparation of Foam Inhibited Mineral Oil Compositions

Each of the above-modified additive compositions are then mixed with SAE 90 paraffinic mineral oil. The procedure is identical to that described in Example 3. Each 200 gram batch of foam inhibited mineral oil lubricating composition is obtained in accordance with the following working procedure: 6.4 grams of each modified dispersion and 193.6 grams of mineral oil; each example of the foam inhibited mineral oil composition contains 9.6 parts per million of the organosiloxane polymers. The modified additive compositions are found in Table V below:

TABLE V

| Modified Additive Composition | | | Foam Inhibited Mineral Oil Composition | |
|---|---|---|---|---|
| Example | 13 | → | Example | 22 |
| " | 14 | → | " | 23 |
| " | 15 | → | " | 24 |

TABLE V-continued

| Modified Additive Composition | | | Foam Inhibited Mineral Oil Composition | |
|---|---|---|---|---|
| " | 16 | → | " | 25 |
| " | 17 | → | " | 26 |
| " | 18 | → | " | 27 |
| " | 19 | → | " | 28 |
| " | 20 | → | " | 29 |
| " | 21 | → | " | 30 |

Each sample is used five times to produce a group of five batches of foam inhibited mineral oil lubricating compositions.

A portion of each sample is taken from the batch on the 1st day, 15th day and 30th day after preparation of the foam inhibited mineral oil composition. The samples taken on the 15th and the 30th day are taken at the top and bottom of the column of liquid placed in the measuring cylinder described in Example 3.

The nine groups, thus produced, of five batches of the foam inhibited mineral oil lubricating composition are then examined anti-foam and stability characteristics in accordance with standard specification NF T 60-129-62 mentioned above. These results are summarized in the following Table VI.

TABLE VI

| Foam Inhibited Mineral Oil Lubricating Compositions | | Foaming tendency at 93° C. | | | | | Foam stability at 93° C. | | | | |
|---|---|---|---|---|---|---|---|---|---|---|---|
| | | 1st | 15th day | | 30th day | | 1st | 15th day | | 30th day | |
| | | day | top | bottom | top | bottom | day | top | bottom | top | bottom |
| Example | 22 | 0 | 0 | 0 | 10 $cm^3$ | 0 | 0 | 0 | 0 | 5 secs. | 0 |
| " | 23 | 0 | 0 | 0 | 0 | 10 $cm^3$ | 0 | 0 | 0 | 0 | 6 secs. |
| " | 24 | 0 | 0 | 0 | 0 | 20 $cm^3$ | 0 | 0 | 0 | 0 | 14 secs. |
| " | 25 | 0 | 0 | 0 | 0 | 20 $cm^3$ | 0 | 0 | 0 | 0 | 34 secs. |
| " | 26 | 0 | 0 | 0 | 0 | 10 $cm^3$ | 0 | 0 | 0 | 0 | 10 secs. |
| " | 27 | 0 | 0 | 10 $cm^3$ | 10 $cm^3$ | 0 | 0 | 0 | 6 secs. | 4 secs. | 0 |
| " | 28 | 0 | 0 | 20 $cm^3$ | 0 | 0 | 0 | 0 | 7 secs. | 0 | 0 |
| " | 29 | 0 | 0 | 0 | 0 | 0 | 0 | 0 | 0 | 0 | 0 |
| " | 30 | 0 | 20 $cm^3$ | 0 | 0 | 0 | 0 | 12 secs. | 0 | 0 | 0 |

The results of the experiments carried out at 24° C. are not reported in this table because they give a zero foaming tendency in each case.

The results presented confirm those summarized in Table II namely that a) the various groups of batches of foam inhibited mineral oil compositions have a powerful anti-foam activity and b) the various dispersions of organo-siloxane polymers shown in Table III form homogeneous mixtures, which are stable over a period of time, with mineral oil lubricating compositions which contain additives.

What is claimed is:

1. A storage stable dispersion comprising:

(A) from about 4 to 40 weight percent of an organosiloxane polymer composition comprising (1) from about 80 to 100 weight percent of an organosiloxane polymer of the formula

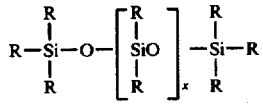

wherein R which can be identical or different is an alkyl group of 1 to 3 atoms and $x$ is a number between 30 to 2,000, (2) from about 0 to 20 weight of silica having a specific surface area greater than 50 $m^2/g$, (B) from about 55 to 95 weight percent of mineral oil, (C) from about 1 to 12 weight percent of an ethylene/vinyl acetate copolymer having a vinyl acetate content from about 15 to 40 weight percent and a melt index of from about 2 to 600 grams per 10 minutes.

2. The dispersion according to claim 1 wherein the organosiloxane polymer is from 7 to 35 weight percent, the mineral oil content is from 60 to 90 weight percent and the ethylene/vinyl acetate copolymer is from 2 to 10 weight percent.

3. The lubricating oil additive composition comprising the dispersion according to claim 1 in an amount to provide said additive composition from about 0.01 to 0.3 weight percent of the organopolysiloxane polymer.

4. The foam-inhibited mineral oil composition comprising a major proportion of mineral oil and a minor amount of the dispersion according to claim 1, said minor amount being sufficient to provide from 5 to 30 parts of the organosiloxane polymer per million parts of the total mineral composition.

5. A process for the prepartion of storage stable dispersions which comprises mixing at a temperature of at least 80° C.

(A) from about 4 to 40 weight percent of an organosilioxane polymer composition comprising (1) from about 80 to 100 weight percent of an organosiloxane polymer of the formula

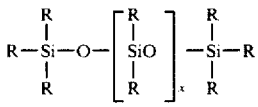

wherein R which can be identical or different is an alkyl group of 1 to 3 atoms and x is a number between 30 to 2,000, (2) from about 0 to 20 weight percent of silica having a specific surface area greater than 50 $m^2/g$, (B) from about 55 to 95 weight percent of mineral oil, (C) from about 1 to 12 weight percent of an ethylene/vinyl acetate copolymer having a vinyl acetate content from about 15 to 40 weight percent and a melt index of from about 2 to 600 grams per 10 minutes.

6. A process of inhibiting foam in mineral oil lubricating compositions having foaming tendencies comprising mixing into said oil a minor amount of the dispersion comprising (A) from about 4 to 40 weight percent of an organosiloxane polymer composition comprising (1) from about 80 to 100 weight percent of an organosiloxane polymer of the formula

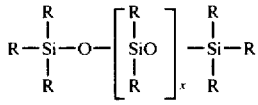

wherein R which can be identical or different is an alkyl group of 1 to 3 atoms and $x$ is a number between 30 to 2,000, (2) from 0 to 20 weight percent of silica having a specific surface area greater than 50 $m^2/g$, (B) from about 55 to 95 weight percent of mineral oil, (C) from about 1 to 12 weight percent of an ethylene/vinyl acetate copolymer having a vinyl acetate content from about 15 to 40 weight percent and a melt index of from about 2 to 600 grams per 10 minutes said minor amount being sufficient to provide from 5 to 30 parts of said organosiloxane polymer (A) per million parts of the total mineral oil composition.

7. The storage stable dispersion as defined in claim 1, essentially consisting of:

(A) from about 4 to 40 weight percent of an organosiloxane polymer composition comprising:

(1) from about 80 to 100 weight percent of an organosiloxane polymer of the formula

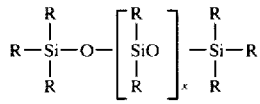

wherein R which can be identical or different is an alkyl group of 1 to 3 atoms and $x$ is a number between 30 to 2,000, (2) from about 0 to 20 weight percent of silica having a specific surface area greater than 50 $m^2/g$, (B) from about 55 to 95 weight percent of mineral oil, (C) from about 1 to 12 weight percent of an ethylene/vinyl acetate copolymer having a vinyl acetate content from about 15 to 40 weight percent and a melt index of from about 2 to 600 grams per 10 minutes.

* * * * *